US010989000B2

(12) United States Patent
Yee

(10) Patent No.: US 10,989,000 B2
(45) Date of Patent: Apr. 27, 2021

(54) METHOD AND APPARATUS FOR PREVENTING PREMATURE SET OF LINER TOP PACKER

(71) Applicant: Chee Kong Yee, Katy, TX (US)

(72) Inventor: Chee Kong Yee, Katy, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/250,301

(22) Filed: Jan. 17, 2019

(65) Prior Publication Data

US 2020/0232293 A1 Jul. 23, 2020

(51) Int. Cl.
*E21B 23/02* (2006.01)
*E21B 43/10* (2006.01)

(52) U.S. Cl.
CPC ..... *E21B 23/02* (2013.01); *E21B 43/108* (2013.01)

(58) Field of Classification Search
CPC ..... E21B 23/02; E21B 43/108
See application file for complete search history.

(56) References Cited

U.S. PATENT DOCUMENTS 3,893,717 A * 7/1975 Nelson ..... E21B 23/02 285/3
4,657,077 A * 4/1987 Smith, Jr. ..... E21B 23/02 166/115
5,186,258 A 2/1993 Wood et al.
5,472,055 A 12/1995 Simson et al.
6,209,653 B1 * 4/2001 Pringle ..... E21B 23/02 166/123
8,201,623 B2 * 6/2012 O'Brien ..... E21B 23/02 166/237
2003/0047320 A1 * 3/2003 Badrak ..... E21B 23/00 166/380
2008/0041597 A1 2/2008 Fisher et al.
2015/0060086 A1 3/2015 Saurer et al.

FOREIGN PATENT DOCUMENTS

WO 2018156175 A1 8/2018

OTHER PUBLICATIONS

International Search Report and Written Opinion for International Application No. PCT/US2019/064109; International Filing Date Dec. 3, 2019; Report dated Mar. 24, 2020 (pp. 1-9).

* cited by examiner

*Primary Examiner* — Nicole Coy
*Assistant Examiner* — Yanick A Akaragwe
(74) *Attorney, Agent, or Firm* — Cantor Colburn LLP

(57) ABSTRACT

A tool for use in a wellbore includes a first tubular having an outer surface and an inner surface defining a first conduit. The inner surface includes a dog engagement zone. A second tubular includes an outer surface portion and an inner surface portion defining a second conduit. The second tubular extends into the first conduit and including a dog opening having a dog support. A dog is arranged in the dog opening. The dog includes an outer surface contour that engages with the dog engagement zone and an inner surface including a recess that engages with the one or more dog supports. The dog is moveably retained between the first tubular and the second tubular.

16 Claims, 8 Drawing Sheets

METHOD AND APPARATUS FOR PREVENTING PREMATURE SET OF LINER TOP PACKER

BACKGROUND

In the resource exploration and recovery industry, liners may be employed when a wellbore is expanded beyond an existing casing. A running tool supports the liner when being tripped into the wellbore. Once the liner is in place, a portion of the liner may be expanded into mechanical engagement with the casing. On occasion, it may be desirable to reciprocate the liner in the wellbore or withdraw the liner from the wellbore before setting if the liner cannot reach an intended position. Reciprocating and/or removing the liner could cause an inadvertent setting of a packer making retrieval difficult. Accordingly, the art would appreciate a liner that could be deployed to a wellbore and retrieved without concern for inadvertent setting.

SUMMARY

Disclosed is a tool for use in a wellbore including a first tubular having an outer surface and an inner surface defining a first conduit. The inner surface includes a dog engagement zone. A second tubular includes an outer surface portion and an inner surface portion defining a second conduit. The second tubular extends into the first conduit and including a dog opening having a dog support. A dog is arranged in the dog opening. The dog includes an outer surface contour that engages with the dog engagement zone and an inner surface including a recess that engages with the one or more dog supports. The dog is moveably retained between the first tubular and the second tubular.

Also disclosed is a method of deploying a tubular into a wellbore including positioning a dog in a dog opening formed in a first tubular, guiding the first tubular into a second tubular, engaging the dog with a dog engagement zone formed on an inner surface of the second tubular, and installing a running tool into the first tubular to radially outwardly bias the dog into the dog engagement zone axially locking the first tubular with the second tubular.

Further disclosed is a resource exploration and recovery system including a first system, a second system including a tubular string and a tool extending into the second system. The tool includes a first tubular including an outer surface and an inner surface defining a first conduit. The inner surface includes a dog engagement zone. A second tubular includes an outer surface portion and an inner surface portion defining a second conduit. The second tubular extends into the first conduit and includes a dog opening having a dog support. A dog is arranged in the dog opening. The dog includes an outer surface contour that engages with the dog engagement zone and an inner surface including at least one recess that engages with the dog support. The dog is moveably retained between the first tubular and the second tubular.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
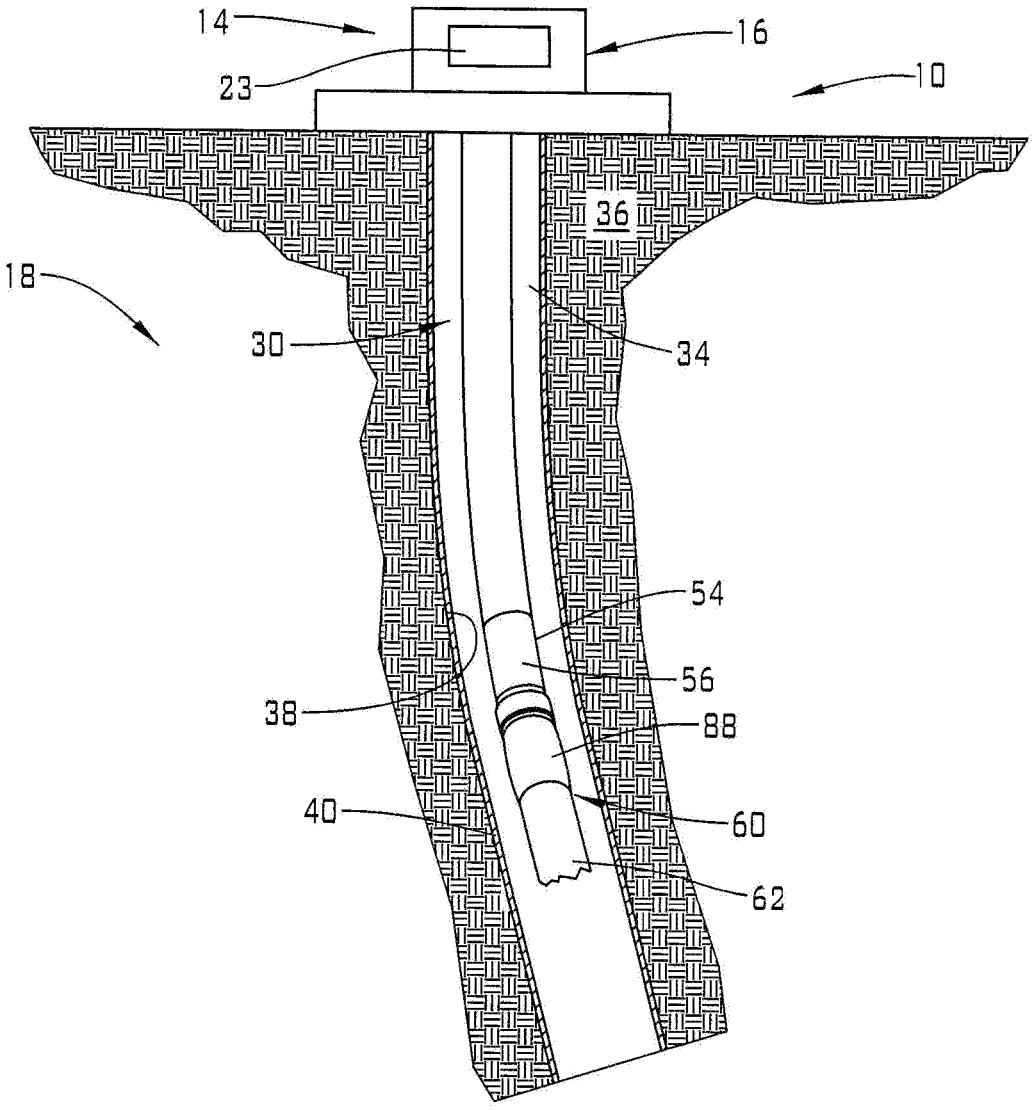
FIG. 1 depicts a resource exploration and recovery system including a tool including dogs that prevent premature tool setting, in accordance with an aspect of an exemplary embodiment.

A resource exploration and recovery system, in accordance with an exemplary embodiment, is indicated generally at 10, in FIG. 1. Resource exploration and recovery system 10 should be understood to include well drilling operations, completions, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a downhole system.

First system 14 may include a control system 23 that may provide power to, monitor, communicate with, and/or activate one or more downhole operations as will be discussed herein. Surface system 16 may include additional systems such as pumps, fluid storage systems, cranes and the like (not shown). Second system 18 may include a tubular string 30 that extends into a wellbore 34 formed in formation 36. Wellbore 34 includes an annular wall 38 which may be defined by a surface of formation 36, or, in the embodiment shown, by a casing tubular 40.

Figure 2:
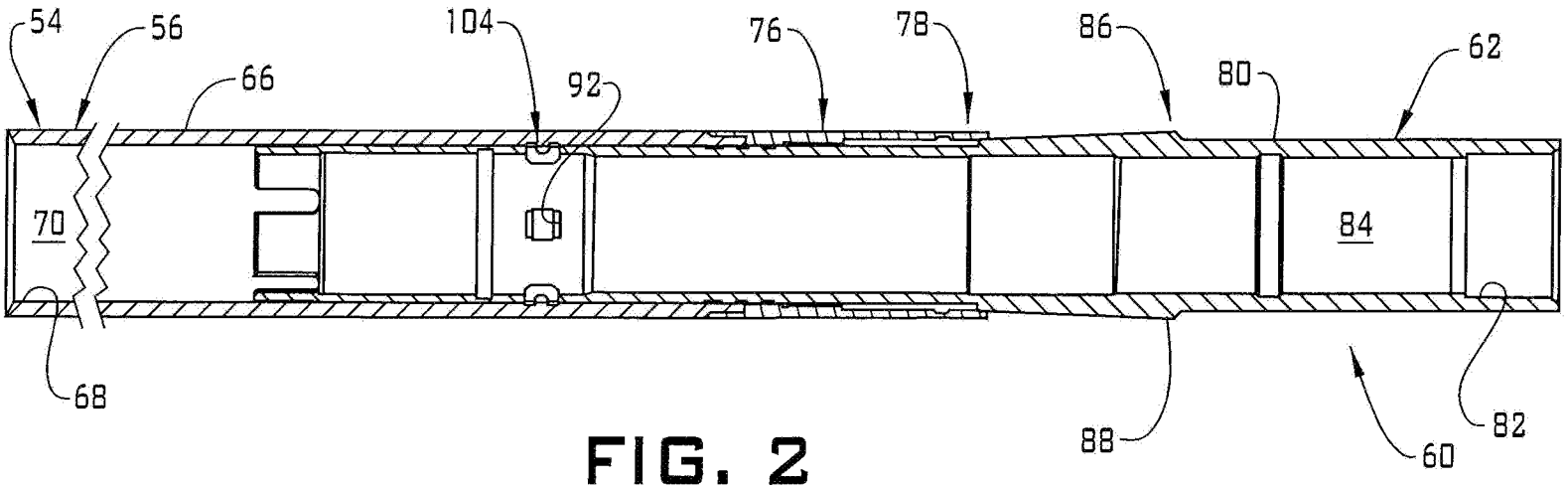
FIG. 2 depicts a cross-sectional side view of the tool of FIG. 1, in accordance with an aspect of an exemplary embodiment.
Figure 6:
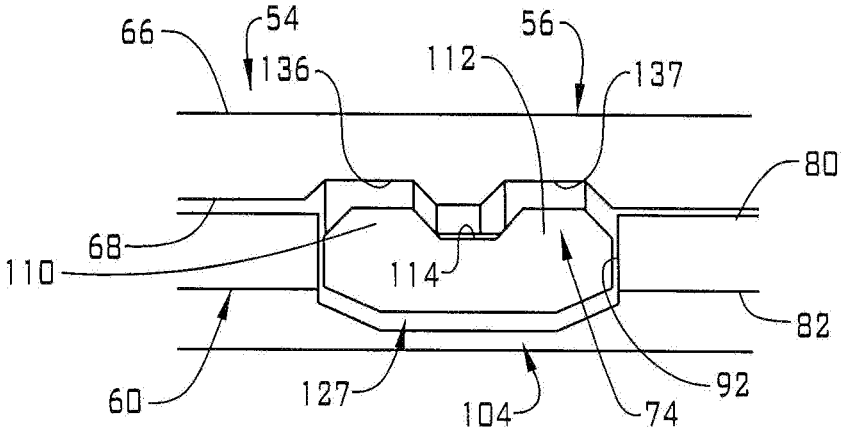
FIG. 6 depicts a dog in a relaxed configuration in the tool of FIG. 2, in accordance with an aspect of an exemplary embodiment.

In an embodiment, a tool 50 may be tripped into tubular string 30. Tool 50 includes a first tubular 54 that may take the form of a tieback extension 56 and a second tubular 60 that may take the form of a mandrel. Referring to FIG. 2, and with continued reference to FIG. 1, first tubular 54 includes an outer surface 66 and an inner surface 68 that defines a first conduit 70. Inner surface 68 includes a dog engagement feature 74 (FIG. 6). First tubular 54 supports an packer system 76 that may include an elastomeric member 78 that is selectively radially outwardly expanded into contact with annular wall 38.

Second tubular 60 includes an outer surface portion 80 and an inner surface portion 82 that defines a second conduit 84. Outer surface portion 80 includes a setting member 86 that selectively radially outwardly expands packer system 76. In an exemplary aspect, setting member 86 may take the form of a setting cone 88 that projects proudly of outer surface portion 80 and may be integrally formed with second tubular 60.

Figure 3:
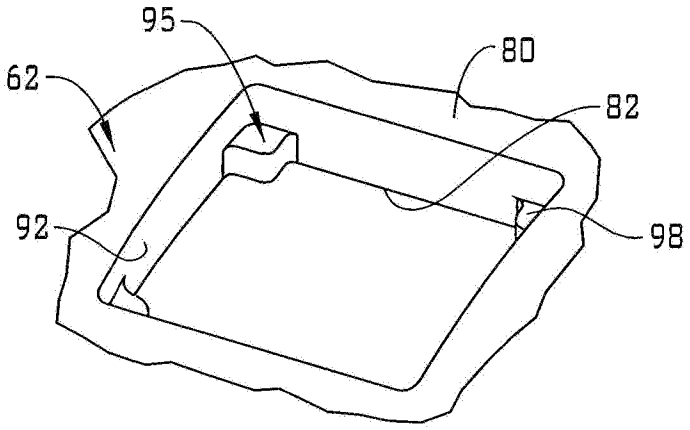
FIG. 3 depicts a dog opening in a tubular of the tool of FIG. 2.

In an embodiment, second tubular 60 includes a plurality of dog openings, one of which is indicated at 92, formed in outer surface portion 80. As shown in FIG. 3, each dog opening 92 includes a plurality of dog supports, one of which is shown at 95. Each dog support 95 takes the form of a flat 98 that projects into dog opening 92 and is spaced from outer surface portion 80. Dog supports 95 support a dog 104 in dog opening 92. As will be discussed herein, dogs 104 selectively axially lock second tubular 60 to first tubular 54.

Figure 4:
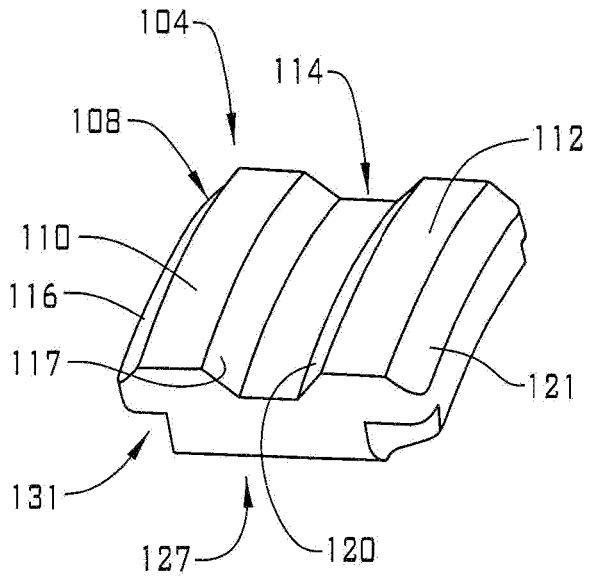
FIG. 4 depicts a top perspective view of a dog of the tool of FIG. 2, in accordance with an aspect of an exemplary embodiment.
Figure 5:
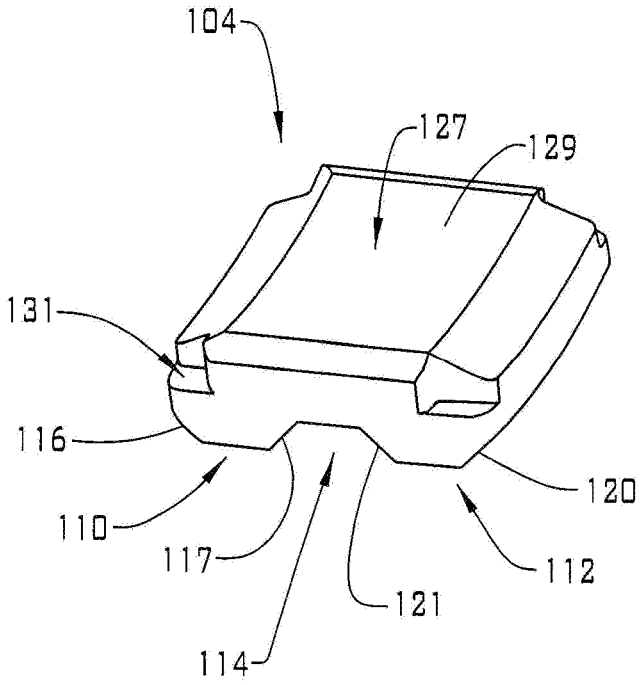
FIG. 5 depicts a bottom perspective view of a dog of the tool of FIG. 2, in accordance with an aspect of an exemplary embodiment.

Referring to FIGS. 4 and 5, dog 104 includes an outer surface contour 108 defined by a first projection 110, a second projection 112, and a recess 114 arranged therebetween. First projection 110 includes a first bevel 116 and a second bevel 117. Second projection 112 includes a third bevel 120 and a fourth bevel 121. Dog 104 also includes an inner surface profile 127 defined by an arcuate surface 129 and a plurality of notches, one of which is indicated at 131. Notches 131 receive corresponding ones of flats 98 to support dog 104 in dog opening 92. In this manner, dog 104 floats or may shift radially outwardly of flats 98.

Figure 7:
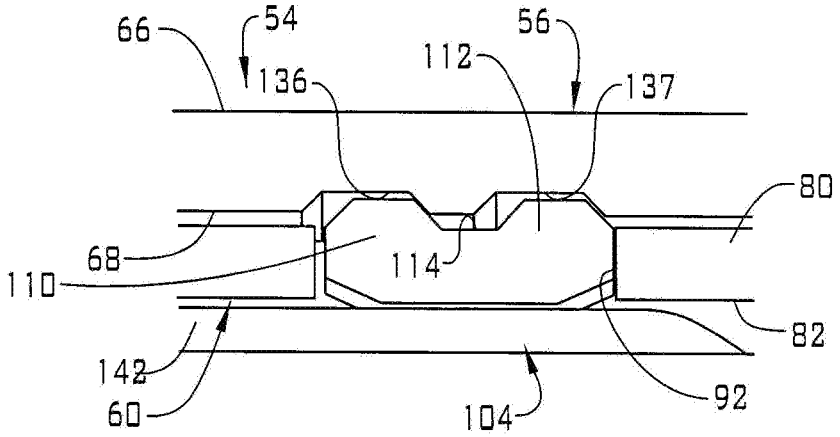
FIG. 7 depicts the dog of FIG. 6 in an engaged configuration, in accordance with an aspect of an exemplary embodiment.
Figure 8:
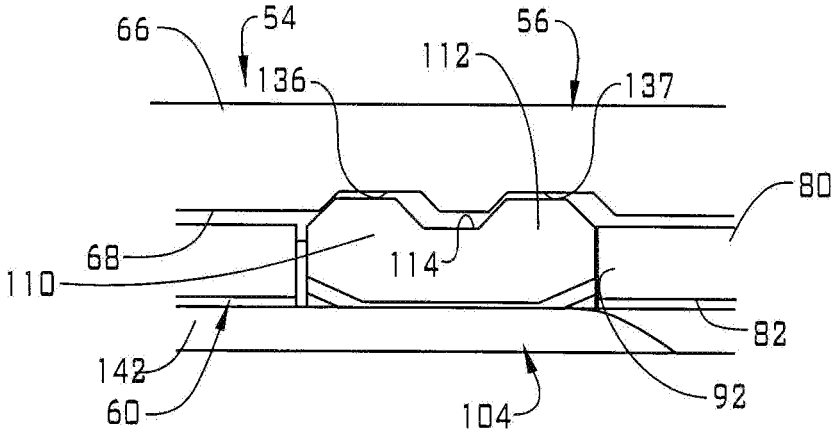
FIG. 8 depicts a first tubular being axially locked to a second tubular with the dog of FIG. 7, in accordance with an aspect of an exemplary embodiment.

Reference will now follow to FIGS. 6-8 in describing dog 104 engaging with dog engagement feature 74. Dog engagement feature 74 may extend annularly around inner surface 68 and includes a first recess zone 136 including first and second angled surfaces (not separately labeled) and a second recess zone 137 including third and fourth angled surfaces (also not separately labeled). First recess zone 136 is sized and shaped to receive first projection 110 and second recess zone 137 is sized and shaped to receive second projection 112.

In an embodiment, dog 104 may be installed in dog opening 92 and supported by dog supports 95. First tubular 54 is installed over second tubular 60 such that dog 104 aligns with dog engagement feature 74 as shown in FIG. 6. At this point, a running tool 142 may be installed into first conduit 70 and directed into second conduit 84 as shown in FIG. 7. Running tool 142 radially outwardly displaces dog 104 such that first and second projections 110 and 112 extend into corresponding ones of first and second recess zones 136 and 137. As running tool 142 engages with second tubular 60 first and third bevels 116 and 120 may engage with the angled surfaces of each of first and second recess zones 136 and 137 as shown in FIG. 8. In this configuration, second tubular 60 may be axially locked to first tubular 54 and may be run into or out of wellbore 34 without risk of activating or expanding packer system 76.

Figure 9:
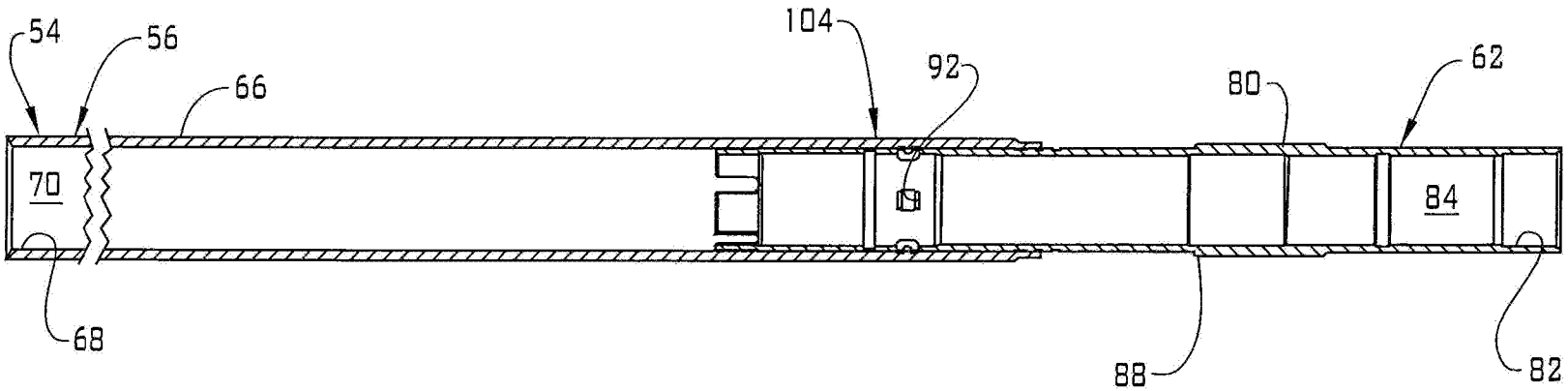
FIG. 9 depicts first and second tubulars of the tool of FIG. 2 with the dog being in the relaxed configuration prior to being introduced into a wellbore, in accordance with an aspect of an exemplary embodiment.
Figure 10:
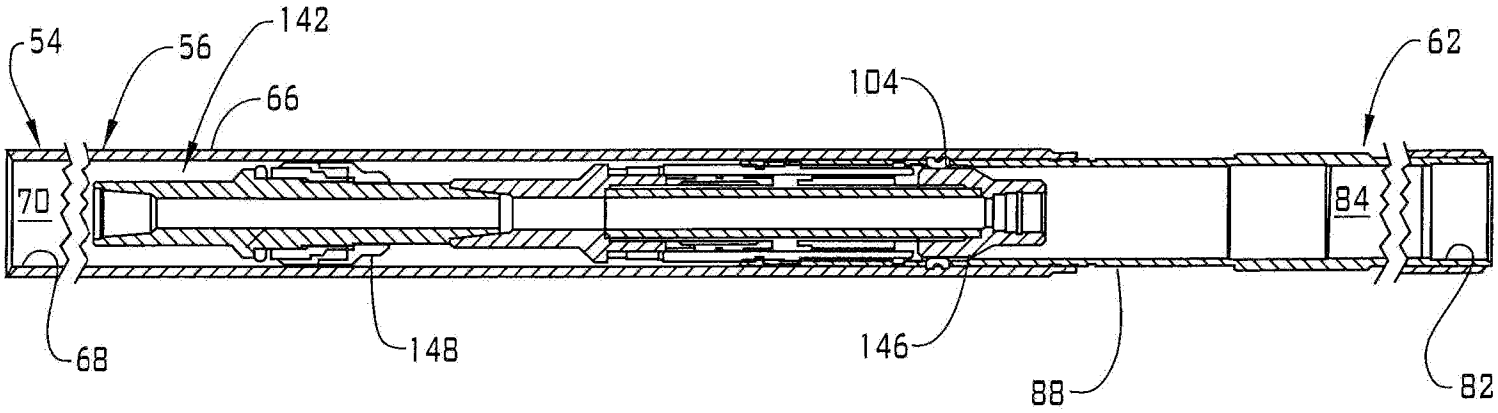
FIG. 10 depicts a running tool being inserted into the tool of FIG. 9 to shift the dog into the engaged configuration.

Reference will now follow to FIGS. 9-12 in describing a method of deploying tool 50 and setting packer system 76. Initially, first tubular 54 is installed over second tubular 60 such that dog 104 aligns with dog engagement feature 74 as shown in FIG. 9. Running tool 142 may then be installed into first conduit 70 so as to radially outwardly displace dog 104. A force may be applied to axially lock first tubular 54 to second tubular 50 as shown in FIG. 10.

Figure 11:
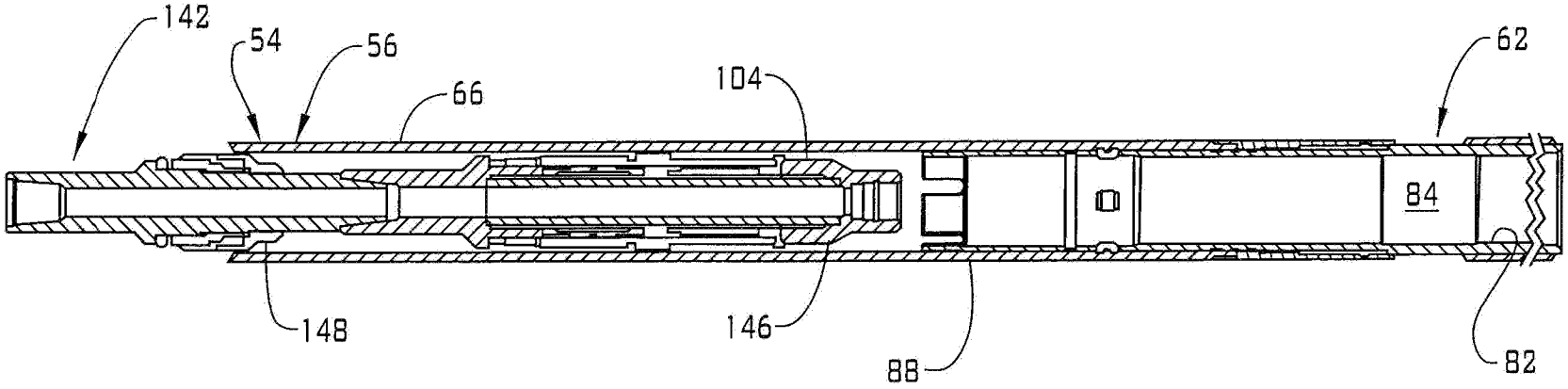
FIG. 11 depicts the running tool being withdrawn from tubular of FIG. 10, in accordance with an aspect of an exemplary embodiment.
Figure 12:
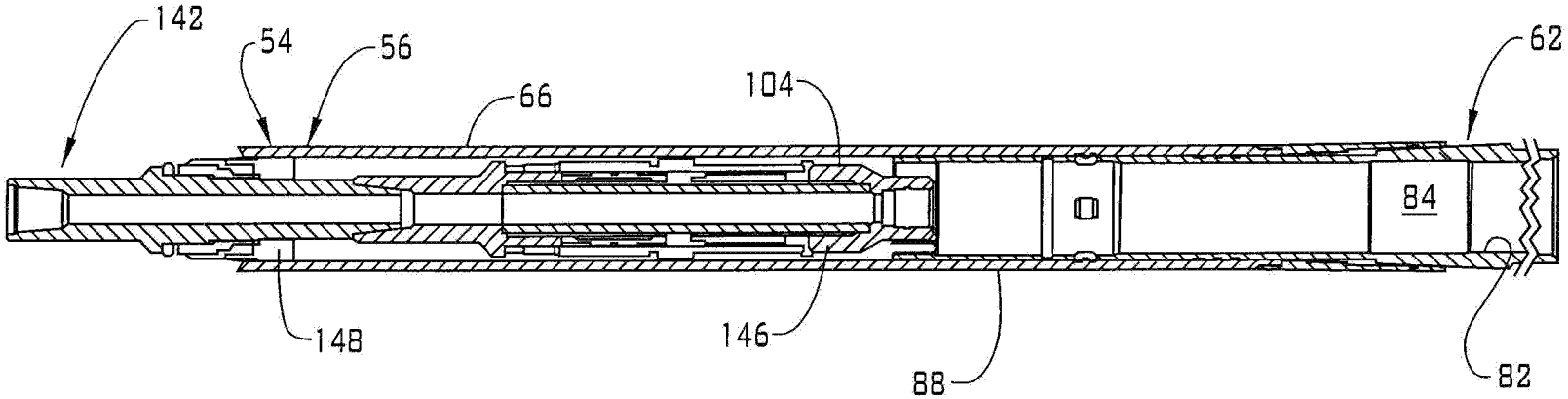
FIG. 12 depicts the first tubular shifting relative to the second tubular to set a packer of the tool, in accordance with an aspect of an exemplary embodiment.

Tool 50 may then be directed into tubular string 30 to a selected depth as shown in, for example, FIG. 1. At this point, a mandrel retaining feature 146 of running tool 142 may be released after a liner hanger (not shown) arranged below running tool 142 engages inner surface 68. Running tool 142 may then be axially shifted relative to tool 50 until setting dogs 148 of running tool 142 are arranged at an axial end (not separately labeled) of first tubular 54 as shown in FIG. 11 releasing dogs 104 from first tubular 54. Set down weight may then be applied causing first tubular to shift relative to second tubular 60 causing setting member 86 to radially outwardly expand packer system 60 as shown in FIG. 12.

Set forth below are some embodiments of the foregoing disclosure:

Embodiment 1

A tool for use in a wellbore comprising: a first tubular including an outer surface and an inner surface defining a first conduit, the inner surface including a dog engagement zone; a second tubular including an outer surface portion and an inner surface portion defining a second conduit, the second tubular extending into the first conduit and including a dog opening having a dog support; and a dog arranged in the dog opening, the dog including an outer surface contour that engages with the dog engagement zone and an inner surface including a recess that engages with the one or more dog supports, the dog being moveably retained between the first tubular and the second tubular.

Embodiment 2

The tool according to any previous embodiment, wherein the first tubular includes a first end, a second end and an intermediate portion defining the first conduit, the second end supporting a packer system that extends over the second tubular.

Embodiment 3

The tool according to any previous embodiment, further comprising: a running tool extending into the first end of the first tubular and into the second conduit, the running tool biasing the dog radially outwardly into contact with the dog engagement zone.

Embodiment 4

The tool according to any previous embodiment, wherein the second tubular includes a setting member arranged on the outer surface portion, the setting member selectively radially expanding the packer system.

Embodiment 5

The tool according to any previous embodiment, wherein the setting member defines a setting cone provided at the outer surface portion of the second tubular.

Embodiment 6

The tool according to any previous embodiment, wherein the dog support comprises a plurality of flats projecting into the dog opening spaced from the outer surface portion.

Embodiment 7

The tool according to any previous embodiment, wherein the outer surface contour comprises a first projection spaced from a second projection and a recess arranged between the first and second projections.

Embodiment 8

The tool according to any previous embodiment, wherein the dog selectively axially locks the first tubular to the second tubular.

Embodiment 9

A method of deploying a tubular into a wellbore comprising: positioning a dog in a dog opening formed in a first tubular; guiding the first tubular into a second tubular; engaging the dog with a dog engagement zone formed on an inner surface of the second tubular; and installing a running tool into the first tubular to radially outwardly bias the dog into the dog engagement zone axially locking the first tubular with the second tubular.

Embodiment 10

The method according to any previous embodiment, shifting the first and second tubulars to a selected depth into the wellbore.

Embodiment 11

The method according to any previous embodiment, further comprising: withdrawing the running tool from the first tubular into the second tubular to axially unlock the first and second tubulars.

Embodiment 12

The method according to any previous embodiment, wherein withdrawing the running tool from the first tubular includes exposing one or more setting dogs.

Embodiment 13

The method according to any previous embodiment, further comprising: axially shifting the second tubular relative to the first tubular with the running tool.

Embodiment 14

The method according to any previous embodiment, wherein axially shifting the second tubular includes applying a downwardly directed force to the second tubular through the setting dogs.

Embodiment 15

The method according to any previous embodiment, wherein axially shifting the second tubular includes radially outwardly expanding a packer carried by the second tubular.

Embodiment 16

A resource exploration and recovery system comprising: a first system; a second system including a tubular string, a tool extending into the second system, the tool comprising: a first tubular including an outer surface and an inner surface defining a first conduit, the inner surface including a dog engagement zone; a second tubular including an outer surface portion and an inner surface portion defining a second conduit, the second tubular extending into the first conduit and includes a dog opening having a dog support; and a dog arranged in the dog opening, the dog including an outer surface contour that engages with the dog engagement zone and an inner surface including at least one recess that engages with the dog support, the dog being moveably retained between the first tubular and the second tubular.

Embodiment 17

The resource exploration and recovery system according to any previous embodiment, wherein the first tubular includes a first end, a second end and an intermediate portion defining the first conduit, the second end supporting a packer system that extends over the second tubular.

Embodiment 18

The resource exploration and recovery system according to any previous embodiment, further comprising: a running tool extending into the first end of the first tubular and into the second conduit, the running tool biasing the dog radially outwardly into contact with the dog engagement zone.

Embodiment 19

The resource exploration and recovery system according to any previous embodiment, wherein the dog support comprises a plurality of flats projecting into the dog opening spaced from the outer surface portion.

Embodiment 20

The tool according to any previous embodiment, wherein the outer surface contour comprises a first projection spaced from a second projection and a recess arranged between the first and second projections.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A tool for use in a wellbore comprising:

a first tubular including an outer surface and an inner surface, a first end, a second end, and an intermediate portion defining a first conduit, the inner surface including a dog engagement zone;

a second tubular including an outer surface portion and an inner surface portion defining a second conduit, the second tubular extending into the first conduit and including a dog opening having a dog support, the dog opening extending completely through the second tubular and the dog support projecting from the second tubular into the dog opening, wherein the second end of the first tubular supports a packer system that extends over the second tubular and the second tubular includes a setting member arranged on the outer surface portion, the setting member selectively radially expanding the packer system; and a dog arranged in the dog opening, the dog including an outer surface contour that engages with the dog engagement zone and an inner surface including a recess that engages with the dog support, the dog being moveably retained between the first tubular and the second tubular.

2. The tool according to claim 1, further comprising: a running tool extending into the first end of the first tubular and into the second conduit, the running tool biasing the dog radially outwardly into contact with the dog engagement zone.

3. The tool according to claim 1, wherein the setting member defines a setting cone provided at the outer surface portion of the second tubular.

4. The tool according to claim 1, wherein the dog support comprises a plurality of flats projecting into the dog opening spaced from the outer surface portion.

5. The tool according to claim 1, wherein the outer surface contour comprises a first projection spaced from a second projection and a recess arranged between the first and second projections.

6. The tool according to claim 1, wherein the dog selectively axially locks the first tubular to the second tubular.

7. A method of deploying a tubular into a wellbore comprising:

positioning a dog in a dog opening extending completely through a first tubular having a first end, a second end;

supporting the dog on a dog support projecting into the opening;

guiding the first tubular into a second tubular including a setting member;

engaging the dog with a dog engagement zone formed on an inner surface of the second tubular;

installing a running tool into the first tubular, the running tool engaging the dog to radially outwardly bias the dog into the dog engagement zone axially locking the first tubular with the second tubular; and radially expanding a packer system extending about the second tubular and supported on the second end of the first tubular with the setting member.

8. The method of claim 7, shifting the first and second tubulars to a selected depth into the wellbore.

9. The method of claim 8, further comprising: withdrawing the running tool from the first tubular into the second tubular to axially unlock the first and second tubulars.

10. The method of claim 9, wherein withdrawing the running tool from the first tubular includes exposing one or more setting dogs.

11. The method of claim 10, further comprising: axially shifting the second tubular relative to the first tubular with the running tool.

12. The method of claim 11, wherein axially shifting the second tubular includes applying a downwardly directed force to the second tubular through the setting dogs.

13. A resource exploration and recovery system comprising:

a first system;

a second system including a tubular string; and a tool extending into the second system, the tool comprising:

a first tubular including an outer surface and an inner surface, a first end, a second end, and an intermediate portion defining a first conduit, the second end supporting a packer system that extends over the second tubular and the inner surface including a dog engagement zone;

a second tubular including an outer surface portion and an inner surface portion defining a second conduit, the second tubular extending into the first conduit and including a dog opening having a dog support, the dog opening extending completely through the second tubular and the dog support projecting from the second tubular into the dog opening, wherein the second tubular includes a setting member arranged on the outer surface portion, the setting member selectively radially expanding the packer system; and a dog arranged in the dog opening, the dog including an outer surface contour that engages with the dog engagement zone and an inner surface including at least one recess that engages with the dog support, the dog being moveably retained between the first tubular and the second tubular.

14. The resource exploration and recovery system according to claim 13, further comprising: a running tool extending into the first end of the first tubular and into the second conduit, the running tool biasing the dog radially outwardly into contact with the dog engagement zone.

15. The resource exploration and recovery system according to claim 13, wherein the dog support comprises a plurality of flats projecting into the dog opening spaced from the outer surface portion.

16. The tool according to claim 13, wherein the outer surface contour comprises a first projection spaced from a second projection and a recess arranged between the first and second projections.

* * * * *